US010985508B1

(12) United States Patent
Hsu

(10) Patent No.: US 10,985,508 B1
(45) Date of Patent: Apr. 20, 2021

(54) WATER-PROOF EXPLOSION-FREE AND ELECTRICITY-FREE SAFETY RECEPTACLE

(71) Applicant: Pu-Shih Hsu, Kaohsiung (TW)

(72) Inventor: Pu-Shih Hsu, Kaohsiung (TW)

( * ) Notice: Subject to any disclaimer, the term of this patent is extended or adjusted under 35 U.S.C. 154(b) by 0 days.

(21) Appl. No.: 16/797,386

(22) Filed: Feb. 21, 2020

(51) Int. Cl.

| | |
|---|---|
| ***H01R 13/70*** | (2006.01) |
| ***H01R 13/703*** | (2006.01) |
| ***H01R 13/527*** | (2006.01) |
| ***H01R 13/66*** | (2006.01) |
| ***H01R 24/76*** | (2011.01) |
| ***H01R 13/44*** | (2006.01) |

(52) U.S. Cl.
CPC ..... *H01R 13/7036* (2013.01); *H01R 13/44* (2013.01); *H01R 13/527* (2013.01); *H01R 13/665* (2013.01); *H01R 24/76* (2013.01)

(58) Field of Classification Search
CPC .... H01R 13/44; H01R 13/527; H01R 13/665; H01R 24/76
USPC ..... 200/51.09
See application file for complete search history.

(56) References Cited

U.S. PATENT DOCUMENTS

| | | | | |
|---|---|---|---|---|
| 2,610,266 A * | 9/1952 | Greeson | H01R 13/5219 | 200/51.09 |
| 5,112,237 A * | 5/1992 | Yang | H01R 13/20 | 200/317 |
| 8,152,544 B1 * | 4/2012 | Hung | H01R 13/70 | 439/188 |
| 8,772,655 B2 * | 7/2014 | Lee | H01R 13/7032 | 200/51.09 |

* cited by examiner

*Primary Examiner* — Edwin A. Leon
*Assistant Examiner* — Iman Malakooti
(74) *Attorney, Agent, or Firm* — Rosenberg, Klein & Lee

(57) ABSTRACT

A water-proof and explosion-free reception safety receptacle includes a base having a first conductive member and a second conductive member. At least one conductive unit is connected between the first and second conductive members. A cover is mounted to the base. The at least one conductive unit includes a first seat and a second seat. Two micro switches are respectively connected between the first conductive member and the first seat, and between the second conductive member and the second seat. The at least one conductive unit includes a button switch which is biased by a resilient unit and protrudes through a hole in the cover. When plug is inserted through slots of the cover, the button switch is pushed by the plug to activate the micro switches to form a circuit.

2 Claims, 16 Drawing Sheets

WATER-PROOF EXPLOSION-FREE AND ELECTRICITY-FREE SAFETY RECEPTACLE

BACKGROUND OF THE INVENTION

1. Fields of the Invention

The present invention relates to an electric receptacle, and particularly, to a water-proof and explosion-free reception safety receptacle.

2. Descriptions of Related Art

The conventional electric receptacles are installed to walls or extension cords, and electrically connected with city power source so as to provide electric power to appliances when a plug is connected to the receptacle. There are different industrial standards set to the receptacles and plugs in for different countries.

There are conductive plates located within the receptacle so as to be in contact with the terminal plates of the plug to form a circuit. For safety reasons, the receptacles are designed to accept the plugs that are shaped correspondent to the receptacles.

However, risks still exist, for example, when a metal object is inserted into the receptacle accidently by children, and the metal object contacts the conductive plates, electric shock may happen.

When the sockets are exposed in liquid such as water, people may have different levels of electric shock. If a person touch a metal object that is close to the receptacle, the stronger electric field may cause dangerous result. Besides, the liquid may short the circuit and cause sparks even fire.

When a plug of an appliance is inserted into a receptacle, sparks may be generated, and the sparks may cause fire or even explosion if the sparks is surrounded by flammable gas.

Every plug include a housing to insulate the terminal plates and the housing is made by insulation material, and the plug is easily held by the users.

Another resilient plates have nano coatings so as to have the features of water-proof and insulation. Nevertheless, the nano coatings can be easily peeled off due to friction and impact. Even if the plugs are not used often, the nano coatings may fade away gradually. The users may not well acknowledge that the plugs no longer have the desired features and cause dangerous results.

Yet another safety plugs that are designed to have specific shape and size to the two terminal plates which are cooperated with specific types of receptacles.

There are multiple receptacles in a house or a room, if the receptacles are designed to have different specifications, and different appliances require specific receptacles, this is inconvenient for the users.

These receptacles with specific specifications are not widely used and they are not safe either. When a metal object is inserted into one of the receptacles, electric shock still happens.

The present invention intends to provide a water-proof and explosion-free reception safety receptacle to eliminate the shortcomings mentioned above.

SUMMARY OF THE INVENTION

The present invention relates to a water-proof and explosion-free reception safety receptacle and comprises a base having a first conductive member and a second conductive member. At least one conductive unit is connected between the first and second conductive members. The base has an opening, and a cover is mounted to the opening of the base. The at least one conductive unit has a first seat and a second seat. Two micro switches are respectively disposed between the first conductive member and the first seat, and between the second conductive member and the second seat. The at least one conductive unit has a button switch, and a resilient unit is biased to the underside of the button switch. The cover has multiple slots and at least one hole. The slots are located corresponding to the first and second seats, and the at least one hole is located corresponding to the button switch which protrudes beyond the at least one hole by the resilient unit. The multiple slots accept at least one plug to be inserted therein. The button switch is pushed to compress the resilient unit by the plug to activate the micro switches, so that the first conductive member is electrically connected to the first seat, and the second conductive member is electrically connected to the second seat.

Preferably, the base includes multiple bottom compartments. The first and second seats are respectively located in the bottom compartments. The bottom compartments are insulated. The cover includes multiple top compartments located at the underside thereof. The top compartments are located corresponding to the bottom compartments.

Preferably, each of the top compartments has a seal ring mounted to outside thereof.

Preferably, the button switch has a water-proof cap mounted to the top thereof. The water-proof cap has a connection portion formed on the periphery thereof. The cover has a connection portion formed to the hole, and the connection portion is connected to the connection portion.

Preferably, a power light is connected between the first and second conductive members. The cover has an aperture and the power light is located corresponding to the aperture. A water-proof member is located between the power light and the aperture.

Preferably, a cable is connected between first and second conductive members. The cable has a water-proof portion mounted to outside thereof. The base and the cover each have a notch, and the cable contacts the inner peripheries of the notches. Two water-proof units are located between base and the cover.

Preferably, the at least one conductive unit includes a warning light. The cover includes a bore in which the warning light is located. The warning light includes a first lighting member connected to a first wire, and a second lighting member connected to a second wire. The first wire is connected to the first conductive member, and the second wire is connected between the second seat and the micro switch corresponding to the second seat. The second wire of the second lighting member is connected to the second conductive member, and the second wire is connected between the first seat and the micro switch corresponding to the first seat.

Preferably, a water-proof member is located between the warning light and the bore.

Preferably, the base includes two engaging grooves which are located corresponding to the first and second conductive members. The engaging grooves each have a positioning member engaged therewith. The positioning members are electric conductive and are respectively connected to the first conductive member and the second conductive member. Each positioning member has an engaging portion and a bent portion which is a resilient portion. The engaging portion is located corresponding to a guide hole in the base. Two slides are respectively located between the first conductive member and the engaging groove corresponding to the first conductive member, and between the second conductive member and the engaging groove corresponding to the second conductive member. Each slide has an inclined face. The base has two cut-offs which are respectively located corresponding to the two respective inclined faces. The engaging portion is biased by the bent portion to block the axial projection position of the guide hole and contacts the slide. When the inclined face of the slide is pushed along the axial direction of the guide hole, the inclined face contacts the engaging portion to un-block the axial projection position of the guide hole.

Preferably, the conductive unit includes a lighting unit. The cover has a hole which is located corresponding to the lighting unit. The lighting unit is connected to two wires, wherein one wire is connected to the first conductive member, and another one is connected between the second seat and the micro switch corresponding to the second seat.

The advantages of the present invention are that the safety receptacle of the present invention can be used for industrial purposes or used for extensions cords or receptacles in walls. When the button switch is not pushed, the first and second conductive members, and the first and second seats are not electrically connected to form a circuit due to the micro switches are not activated. That is to say, even a metal object is in contact with the first and second seats, there will be no electric shock happened. The present invention prevents children from being electric shocked even if a metal object is inserted into the receptacle by children. The button switch has to be pushed by the face with terminal plates of a plug and therefore activates the micro switch to form a circuit. The safety feature is enhanced and reliable even when the receptacle is hit, and the safety receptacle of the present invention, so that the safety feature is permanently available.

When the receptacle of the present invention is soaked, because the button switch is not pushed, the first and second conductive members, and the first and second seats are not electrically connected to form a circuit, so that the receptacle is safe.

The present invention includes a warning light which is activated when a circuit is formed between the first conductive member and the first seat, and between the second conductive member and the second seat. The light emitted by the warning light acknowledges the users the operational status of the receptacle. When warning light lights up and no plug is connected to the receptacle, the users are acknowledged that the receptacle does not have the safety features.

There are multiple seal rings located between the cover, the base and the bottom compartments, and between bores and holes for the button switches, the warning lights and the lighting units to keep water from entering into the receptacle.

Thanks to the bottom compartments that is insulated from outside so that the receptacle is safety when being used surrounded by flammable gas because even if the micro switches generate sparks which is not in contact with the flammable gas so that the receptacle is explosion free.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
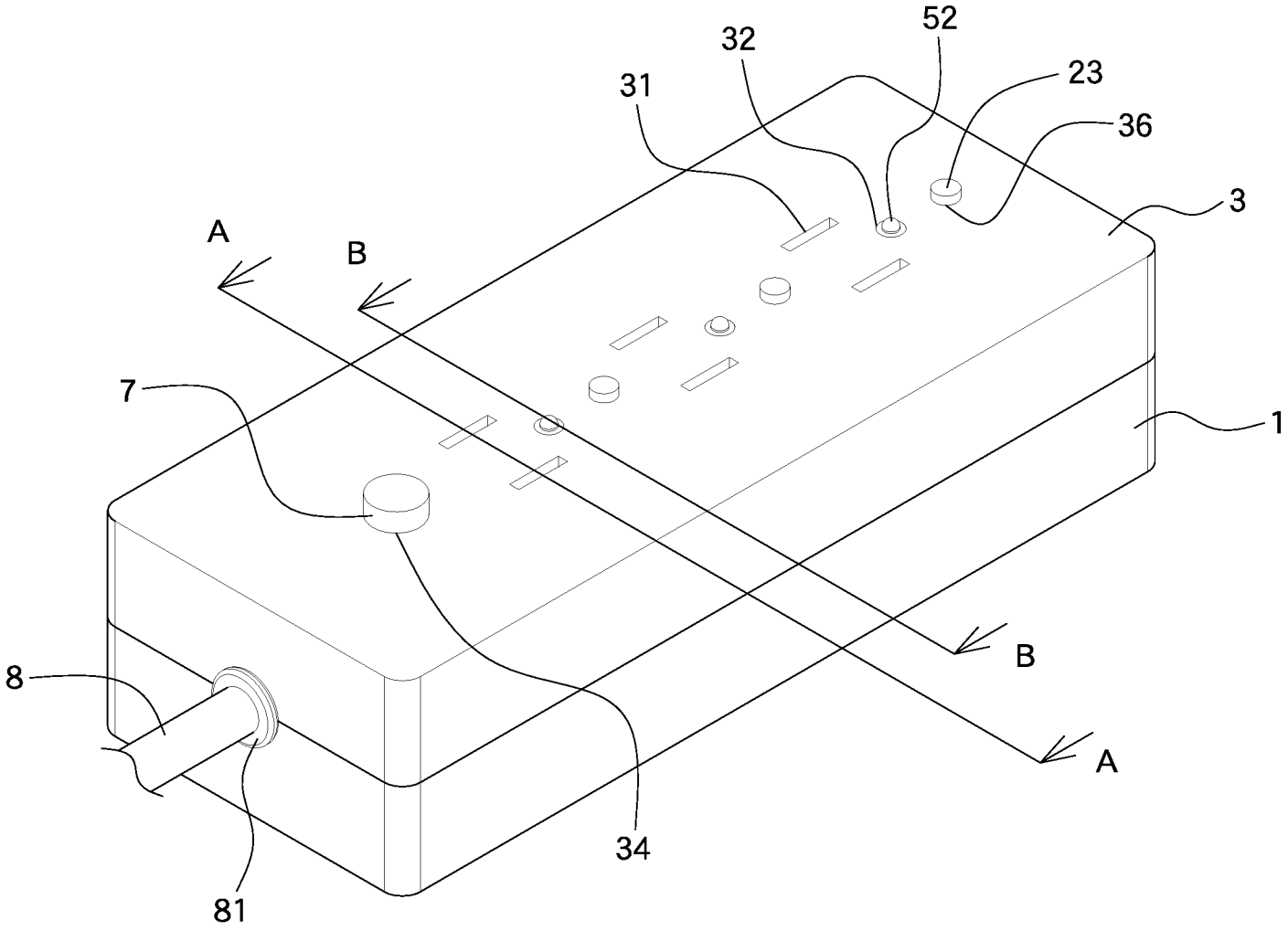
FIG. 1 is a perspective view to show the safety receptacle of the present invention.
Figure 2:
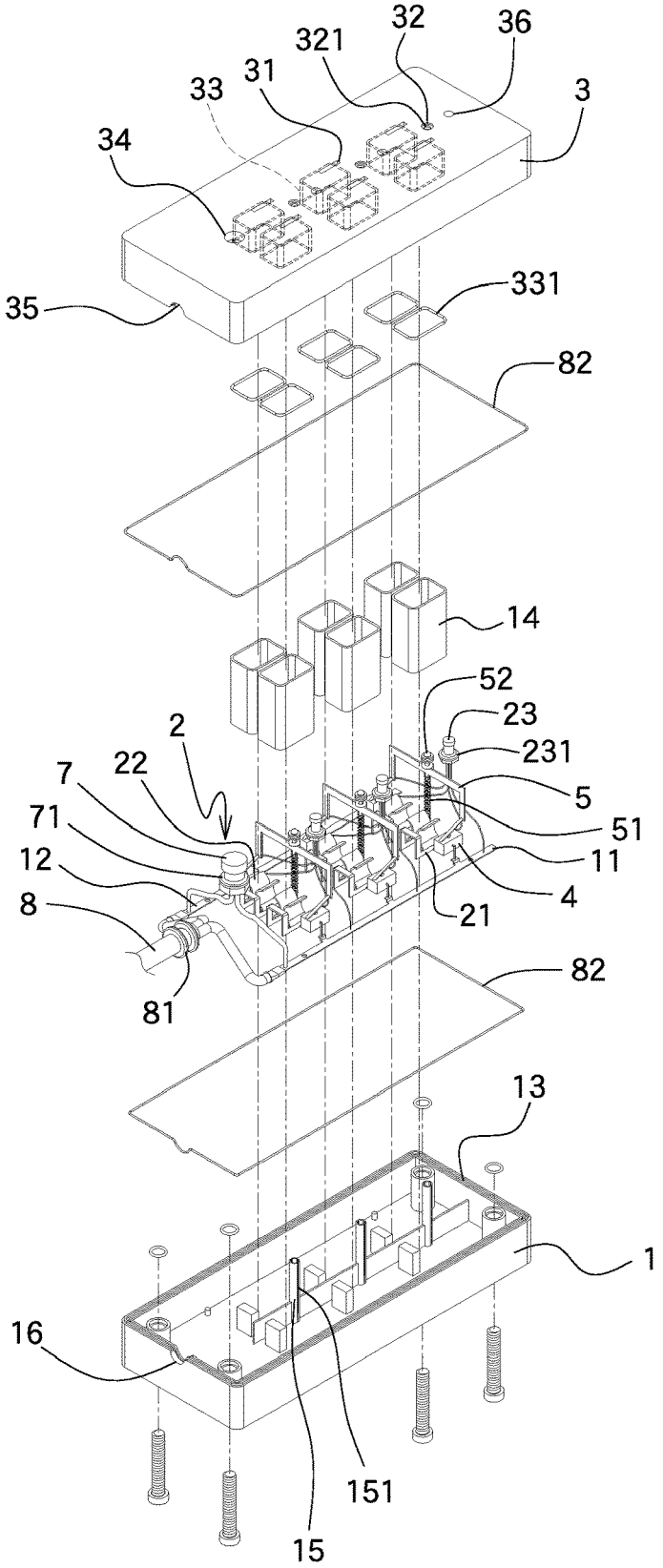
FIG. 2 is an exploded view to show the safety receptacle of the present invention.
Figure 3:
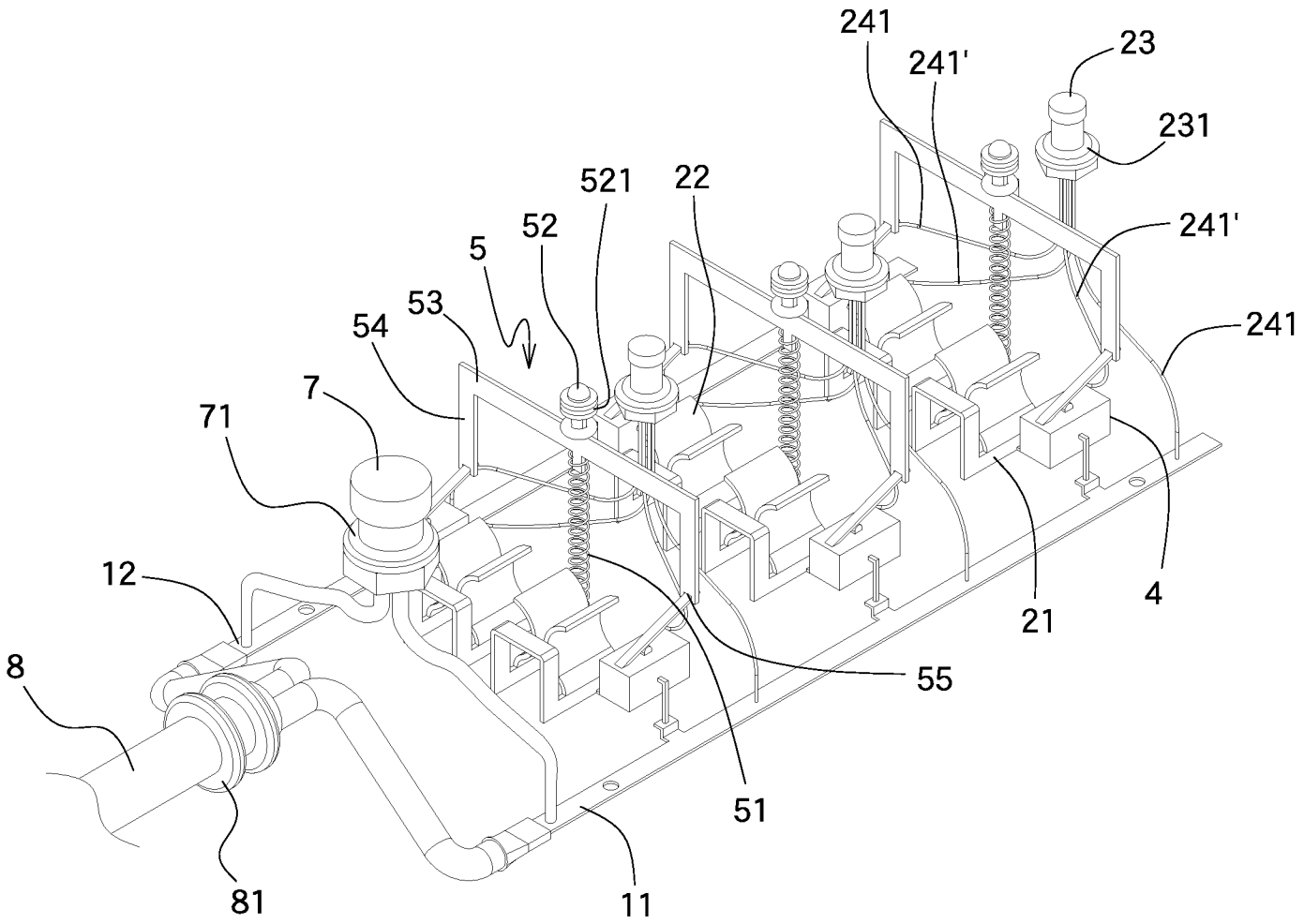
FIG. 3 is a perspective view to show the arrangement of the first and second conductive members, and the bouton switch of the safety receptacle of the present invention.

Referring to FIGS. 1 to 8, the first embodiment of the safety receptacle of the present invention comprises a base 1 having a first conductive member 11 and a second conductive member 12. At least one conductive unit 2 is connected between the first and second conductive members 11, 12. The base 1 has an opening 13, and a cover 3 is mounted to the opening 13 of the base 1.

The at least one conductive unit 2 includes a first seat 21 and a second seat 22. Two micro switches 4 are respectively connected between the first conductive member 11 and the first seat 21, and between the second conductive member 12 and the second seat 22. The at least one conductive unit 2 further has a button switch 5, and a resilient unit 51 biased to the underside of the button switch 5 and the base 1.

The cover 3 includes multiple slots 31 and at least one hole 32, wherein the slots 31 are located corresponding to the first and second seats 21, 22, and the at least one hole 32 is located corresponding to the button switch 5 which protrudes beyond the at least one hole 32 by the resilient unit 51. The multiple slots 31 accept at least one plug 6 to be inserted therein. When the button switches 5 are pushed, the resilient units 51 are compressed and activate the micro switches 4 so that the first conductive member 11 is electrically connected to the first seat 21, and the second conductive member 12 is electrically connected to the second seat 22.

Figure 4:
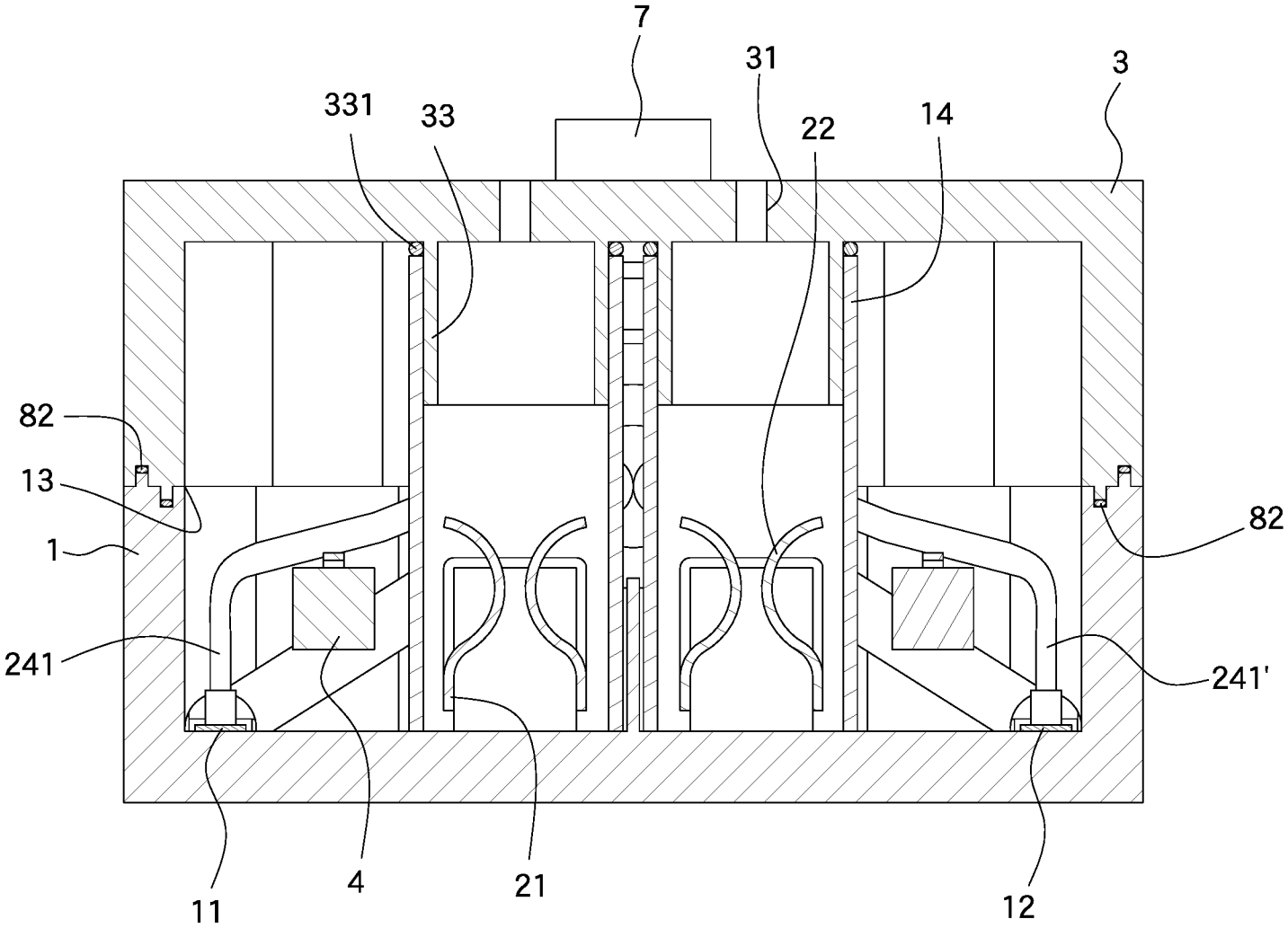
FIG. 4 is a cross sectional view, taken along line A-A of FIG. 1.

As shown in FIG. 4, for the water-proof feature of the present invention, the base includes multiple bottom compartments 14. The first and second seats 21, 22 are respectively located in the bottom compartments 14, and the bottom compartments 14 are insulated. In one embodiment, the bottom compartments 14 are made by plastic which is not restricted to the present invention. The first and second seats 21, 22 are respectively located in the bottom compartments 14 to have the water-proof feature. The cover 3 includes multiple top compartments 33 located at the underside thereof. The top compartments 33 are located corresponding to the bottom compartments 14. The multiple slots 31 are located corresponding to the first and second seats 21, 22, and the top compartments 33 are located corresponding to the slots 31 as well. Preferably, the top compartments 33 are located on an inside of the bottom compartments 14 so that when the receptacle is soaked in water, the water will fill in the bottom compartments 14 and cannot reach to the area between the top and bottom compartments 14, 33. IN order to have satisfied water-proof feature, each of the top compartments 33 has a seal ring 331 mounted to outside thereof. The bottom compartments 14 arrange the seal rings 331 to contact the underside of the cover 3 to prevent water from entering into the receptacle.

Figure 5:
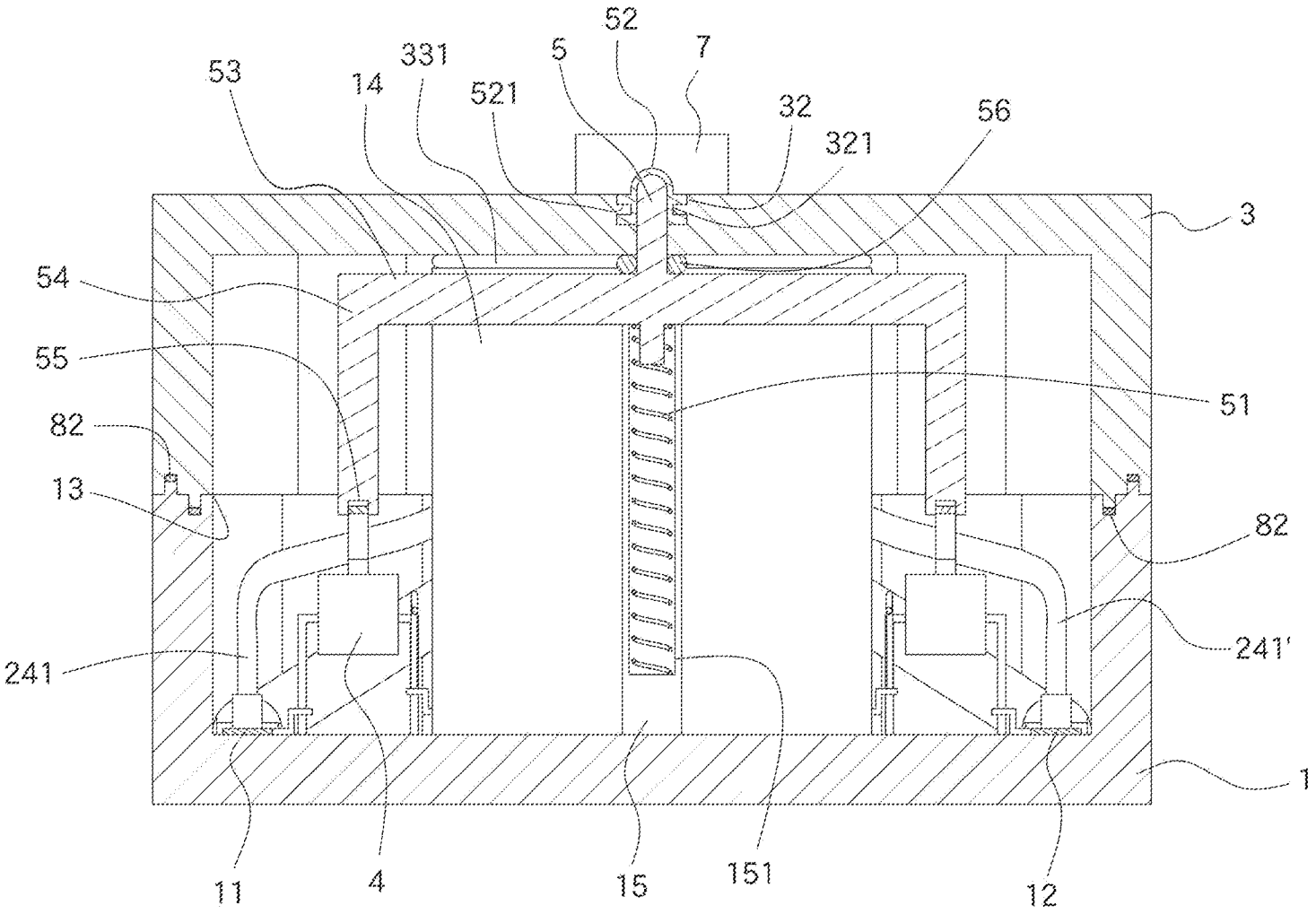
FIG. 5 is a cross sectional view, taken along line B-B of FIG. 1.
Figure 6:
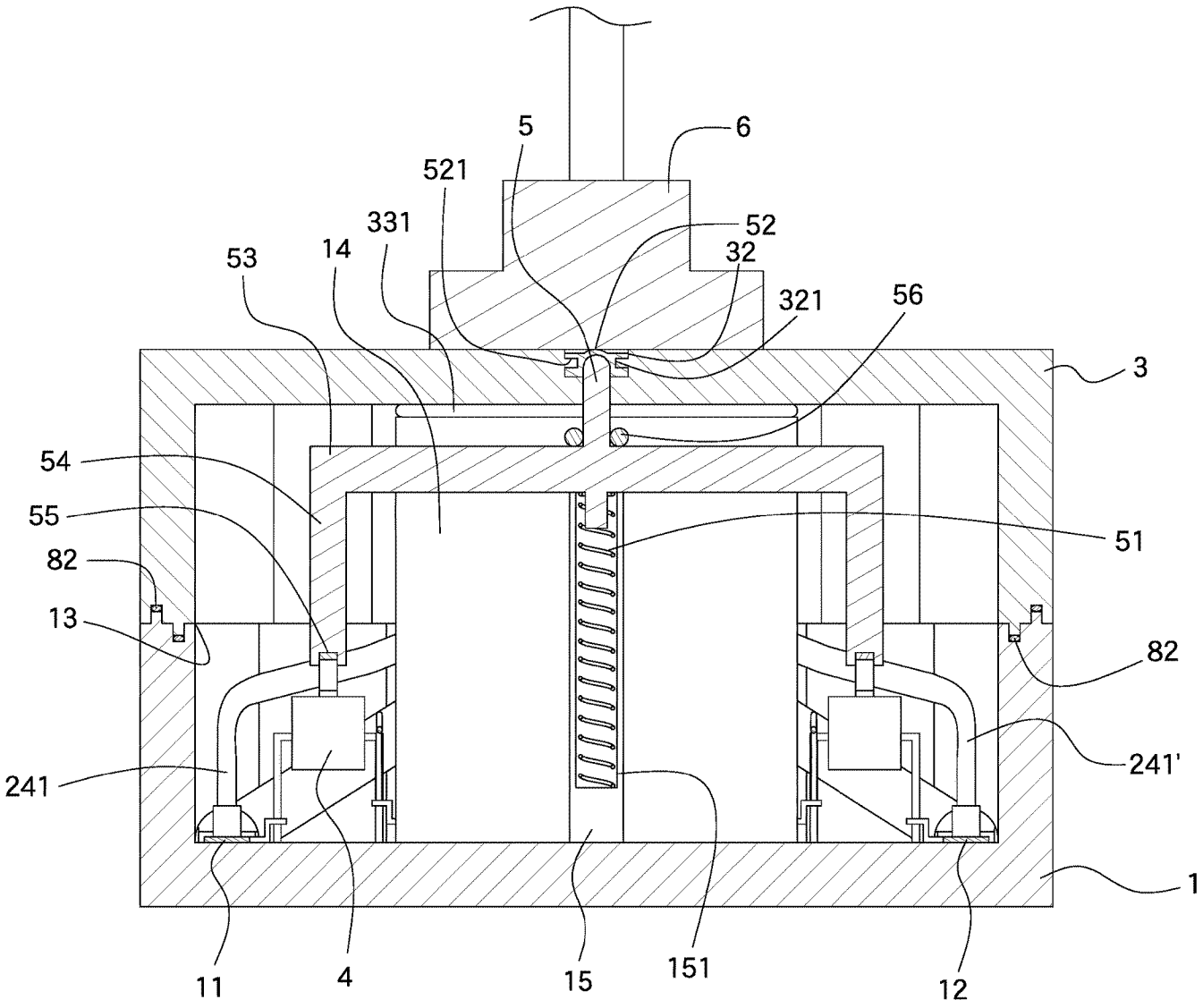
FIG. 6 is a cross sectional view to show that when the plug is inserted into the safety receptacle of the present invention.
Figure 7:
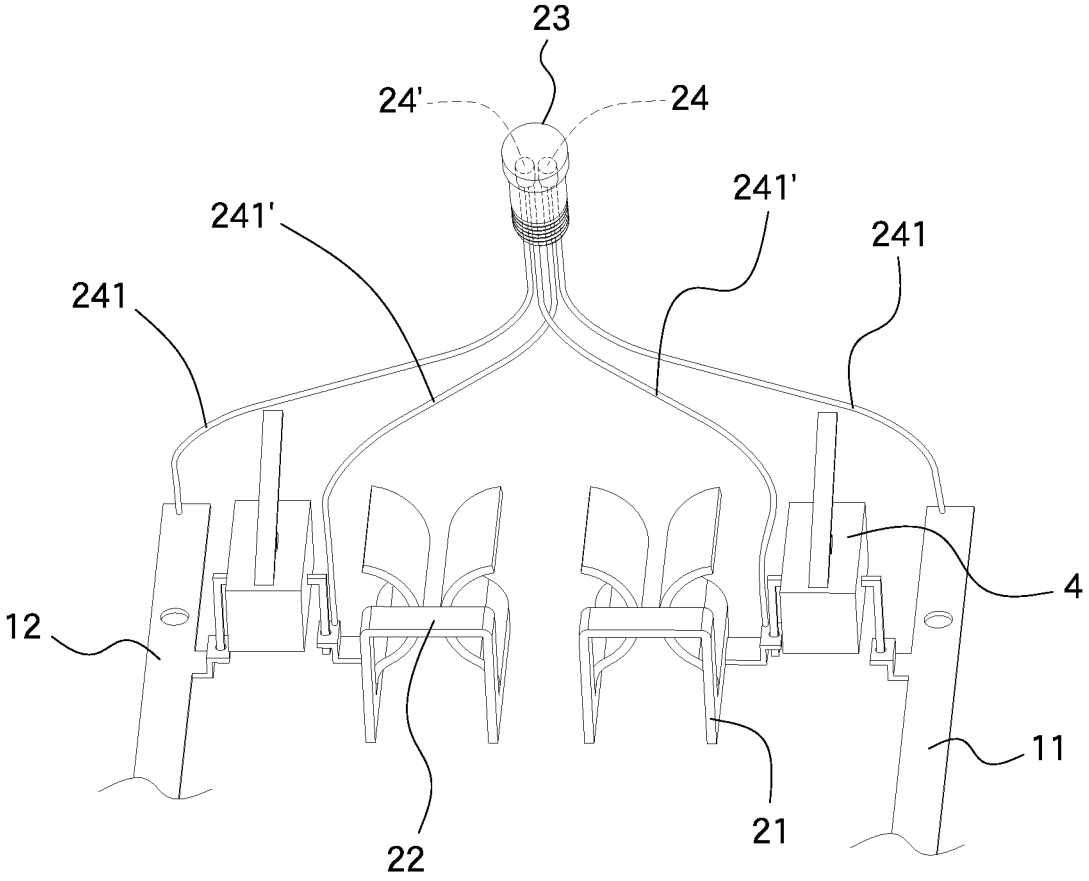
FIG. 7 shows the arrangement of the warning light, the lighting members and the wires of the safety receptacle of the present invention.
Figure 8:
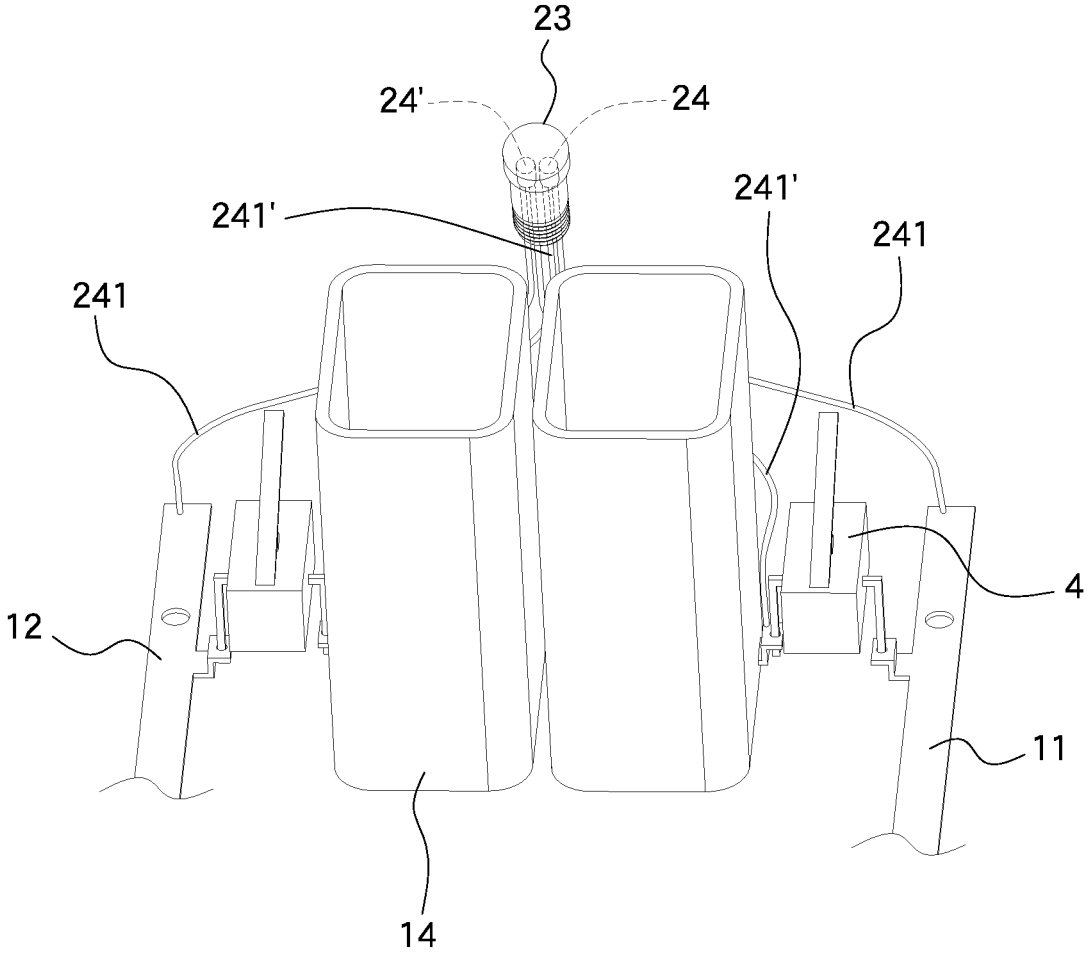
FIG. 8 shows the bottom compartments of the safety receptacle of the present invention.
Figure 9:
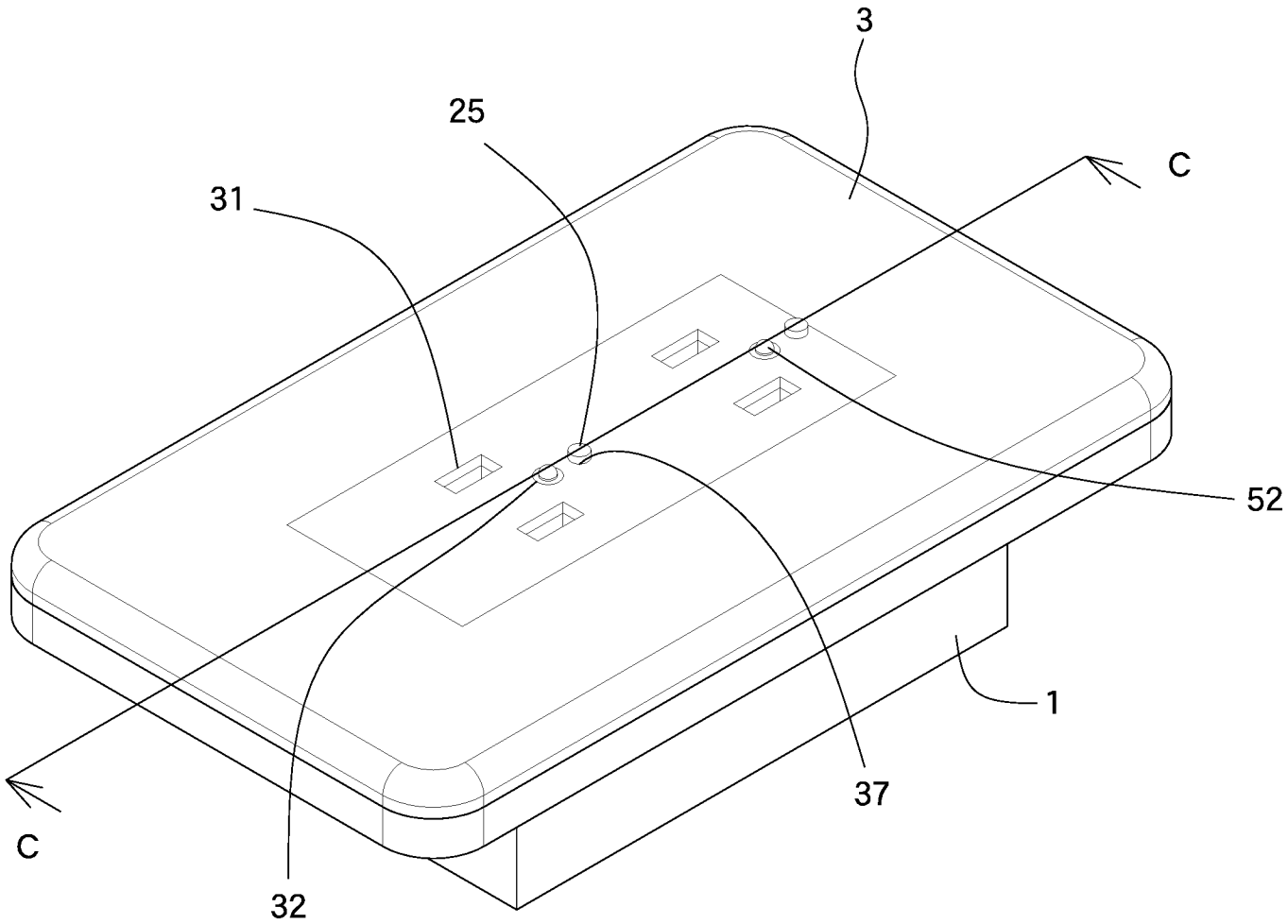
FIG. 9 is a perspective view to show the second embodiment of the safety receptacle of the present invention.
Figure 10:
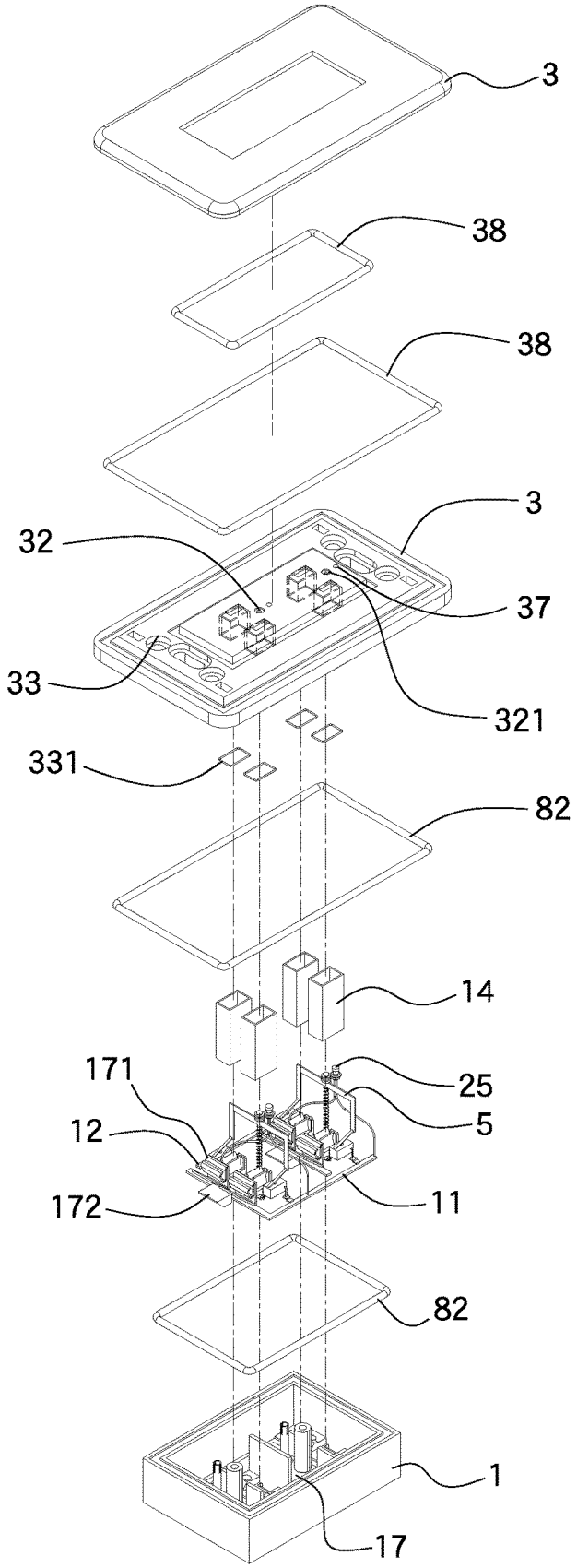
FIG. 10 is an exploded view to show the second embodiment of the safety receptacle of the present invention.
Figure 11:
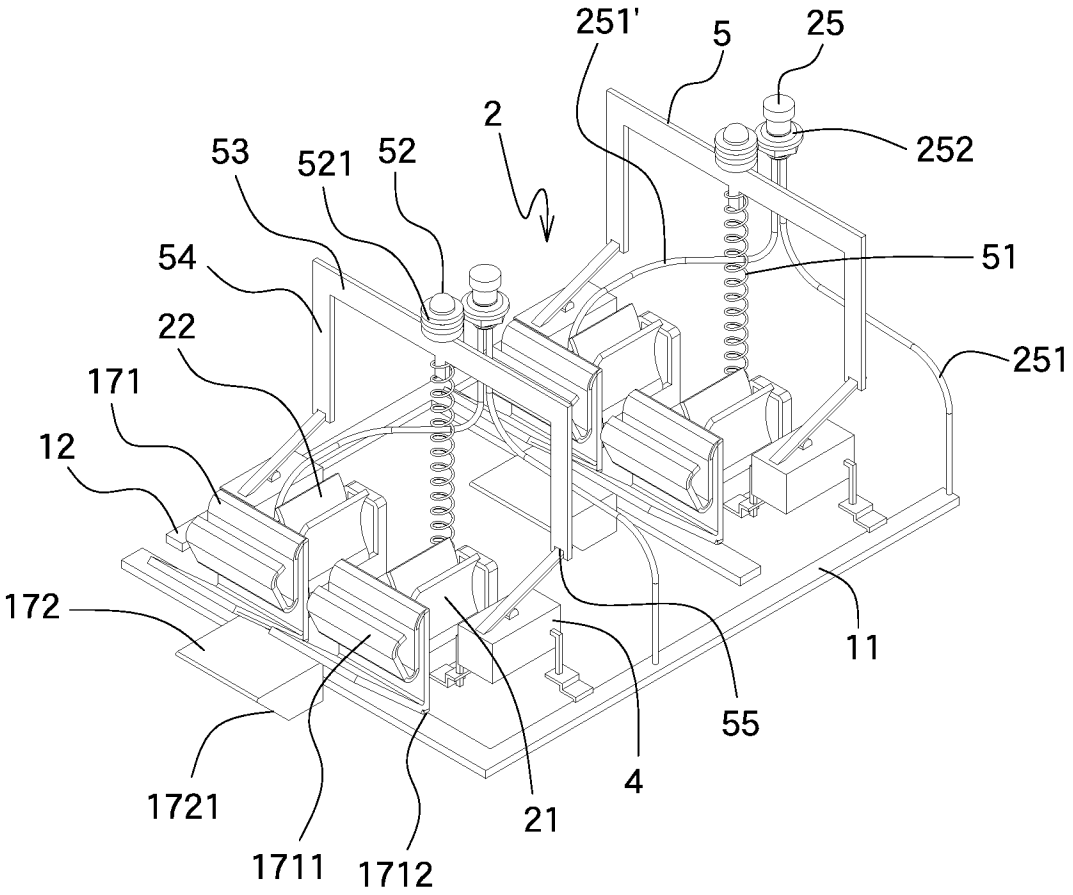
FIG. 11 is a perspective view to show the arrangement of the first and second conductive members, and the bouton switch of the second embodiment of the safety receptacle of the present invention.

As shown in FIGS. 5 and 6, for each button switch 5, the base 1 has a positioning member 15 which accommodates the resilient unit 51. Each positioning member 15 has a restriction groove 151 defined in the wall thereof so as to guide the resilient unit 51 to be activated in upright direction and cannot move in the laterally, so that the button switch 5 is ensured to be pushed to activate the micro switch 4. Each of the button switches 5 has a water-proof cap 52 mounted to the top thereof. The water-proof cap 52 has a connection portion 521 formed on the periphery thereof. The cover 3 has a connection portion 321 formed to the hole 32, and the connection portion 521 is connected to the connection portion 321 to prevent water from entering into the receptacle via the holes 32.

Specifically, each button switch 5 includes two positioning portions 53 on two sides thereof and the positioning portions 53 are located in the restriction slots 151 to prevent the button switch 5 from rotating. Each positioning portion 53 is connected with an upright portion 54 which has a recess 55 defined in the distal end thereof so as to be engaged with the micro switch 4, so that when the button switch 5 is pushed, the micro switch 4 can be activated. When the button switch 5 is not pushed, as shown in FIG. 5, the micro switch 4 is not activated and the circuit is not formed, and the first and second seats 21, 22 are not electrically connected to each other. Even a metal object is in contact with the first and second seats 21, 22, or the safety receptacle is soaked in water, no electric shock will happen. The safety receptacle do not fail even under impact. A seal ring 56 is located between the button switch 5 and the cover 3 to further improve the water-proof feature.

As shown in FIGS. 1 and 6, when a plug 6 of an appliance is inserted to the safety receptacle and contacts the first and second seats 21, 22, the end face with the terminal plates of the plug 6 pushes the button switch 5. Preferably, the button switch 5 and the holes 32 are located close to the slots 31, and the button switch 5 slightly protrudes beyond the cover 3 so that at 97% of the terminal plates are inserted into the receptacle, the button switch 5 is pushed. The resilient unit 51 is then compressed and the upright portions 54 activate the micro switch 4 to form the circuit such that the first conductive member 11 is electrically connected to the first seat 21, and the second conductive member 12 is electrically connected to the second seat 22.

When the safety receptacle is used in a worksite where flammable gas surrounds the safety receptacle, because the button switch 5 is pushed until at 97% of the terminal plates are inserted into the receptacle, and the terminal plates contact the first and second seats 21, 22 at a large area and do not generate sparks. Furthermore, even if sparks are generated, because of the insulated bottom compartments 14, the sparks do not contact outside air and no explosion will happen.

In order to allow the users to be acknowledge whether the first and second conductive members 11, 12 are electrically in contact with each other, a power light 7 is connected between the first and second conductive members 11, 12. When the power light 7 lights up, which means the safety receptacle is in operation. The cover 3 has an aperture 34 and the power light 7 is located corresponding to the aperture 34. A water-proof member 71 is located between the power light 7 and the aperture 34 to prevent water from entering into the safety receptacle. The power light 7 may have a stepped portion and is engaged to the cover 3 from outside of the cover 3. The water-proof member 71 is mounted to the power light from inside of the cover 3. The power light 7 is secured by screws.

For installing an electric wiring 9 with the safety receptacle, a cable 8 is connected between first and second conductive members 11, 12. The cable 8 has a water-proof portion 81 mounted to outside thereof. The base 1 and the cover 3 each have a notch 16/35, and the cable 8 contacts the inner peripheries of the notches 16, 35. Two water-proof units 82 are located between base 1 and the cover 3. By the combination of the cable 8, the base 1 and the cover 3, the safety receptacle is water-proof. As shown in FIGS. 2, 4, 5 and 6, the sides of the base 1 and the cover 3 can be stepped to press and position the water-proof units 82.

In the second embodiment, the at least one conductive unit 2 includes a warning light 23. The cover 3 includes a bore 36 in which the warning light 23 is located. The warning light 23 includes a first lighting member 24 connected to a first wire 241, and a second lighting member 24' connected to a second wire 241'. One end of the first wire 241 is connected to the first conductive member 11, and another end of the first wire 241 is connected between the second seat 22 and the micro switch 4 corresponding to the second seat 22. One end of the second wire 241' of the second lighting member 24' is connected to the second conductive member 12, and another end of the second wire 241' is connected between the first seat 21 and the micro switch 4 corresponding to the first seat 21. When the micro switch 4 on one end of the first seat 21 is activated, the first and second lighting members 24, 24' light up. Similarly, when the micro switch 4 on one end of the second seat 22 is activated, the first and second lighting members 24, 24' light up. The users are acknowledged by the operational status of warning light 23 to judge whether the circuit between the first and second seats 21, 22 is established. When the micro switch 4 fails the function of cutting off the power, so that even when the button switch 5 is not pushed, the warming light 23 still lights up, This means a circuit is formed to the first seat 21 or the second seat 22, the users may replace the micro switch 4 or may use it as an extension cord.

For the water-proof feature to the warning light 23, a water-proof member 231 is located between the warning light 23 and the bore 36. The installation of the water-proof member 231 is similar to that of the power light 7 to prevent water from entering the safety receptacle.

In order to avoid unintentionally pushing the button switch 5, the warning light 23 is installed higher than the button switch 5, to prevent the button switch 5 from being unintentionally pushed. Because the button switch 5 is lower, the safety receptacle can be used as an extension cord.

In order to protect the button switch 5, the button switch 5 is located above the slots 31 so that the insulation housing of the plug 6 can push the button switch 5 to activate the micro switch 4 when 97% of the terminal plates are inserted into the safety receptacle.

It is noted that any plug 6 has the insulation housing which can push the button switch 5 so that the safety receptacle can be used with any conventional plugs 6.

Figure 12:
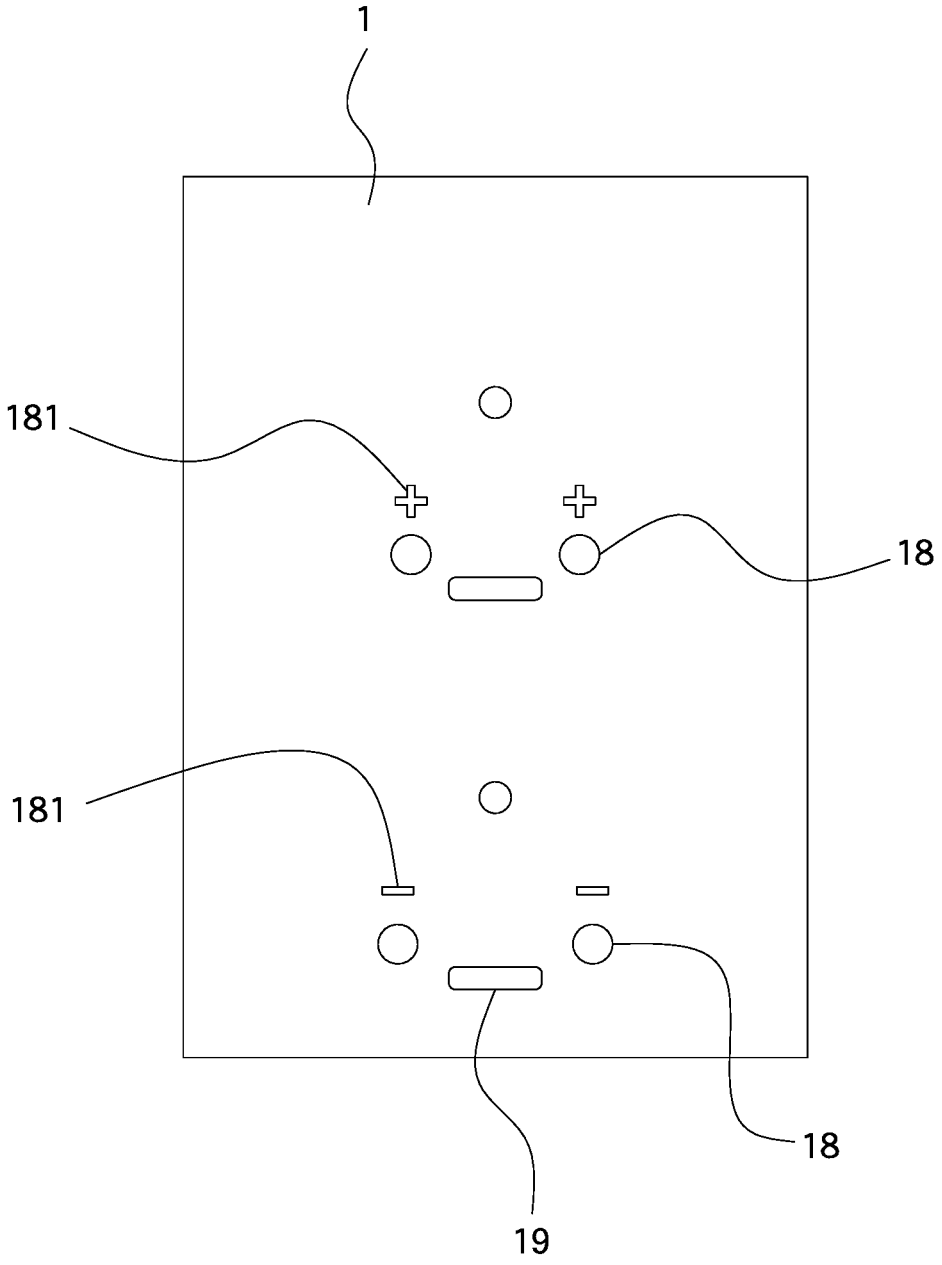
FIG. 12 is a bottom view of the base of the second embodiment of the safety receptacle of the present invention.
Figure 13:
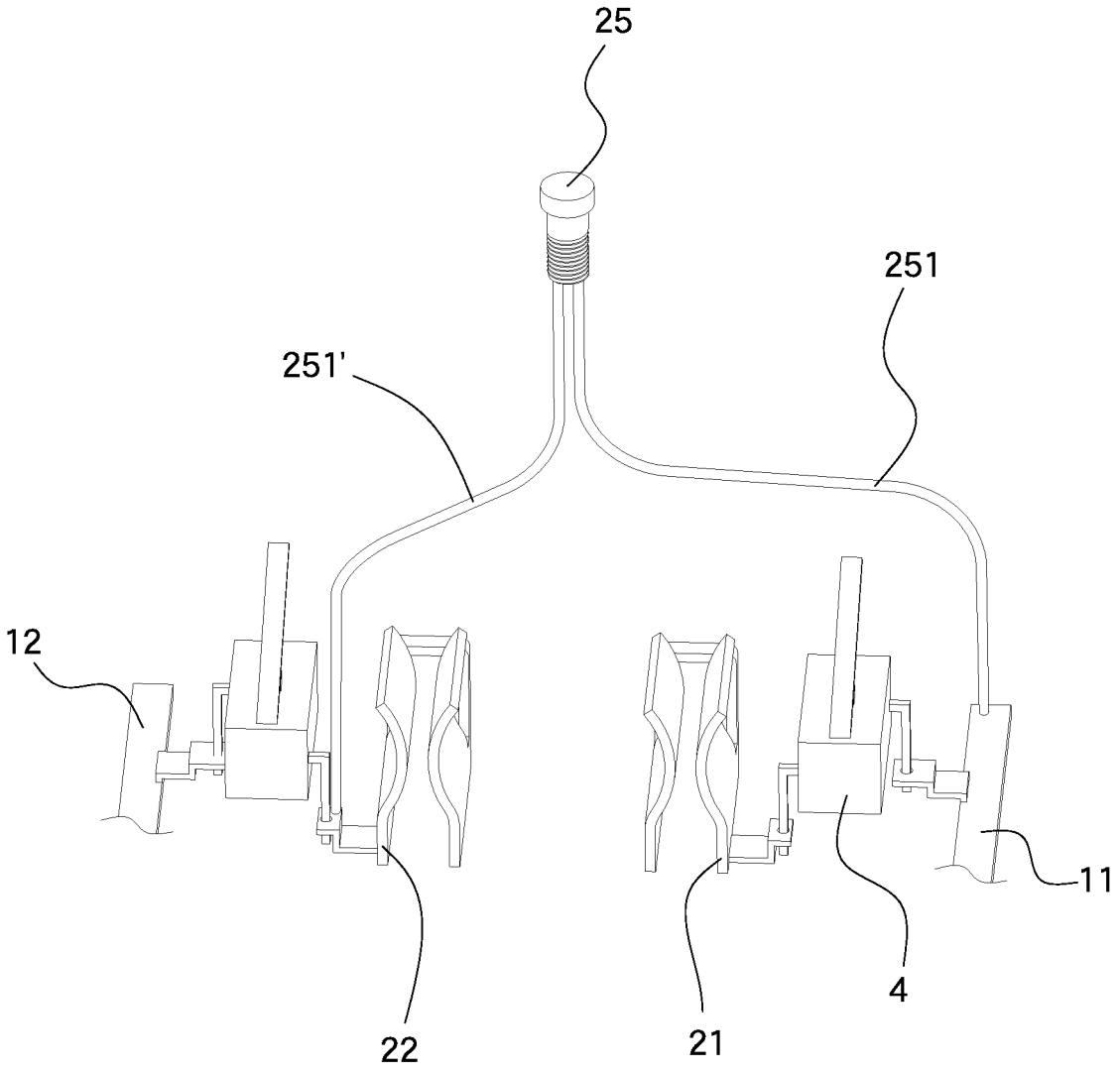
FIG. 13 shows the arrangement of the warning light and the wires of the second embodiment of the safety receptacle of the present invention.
Figure 14:
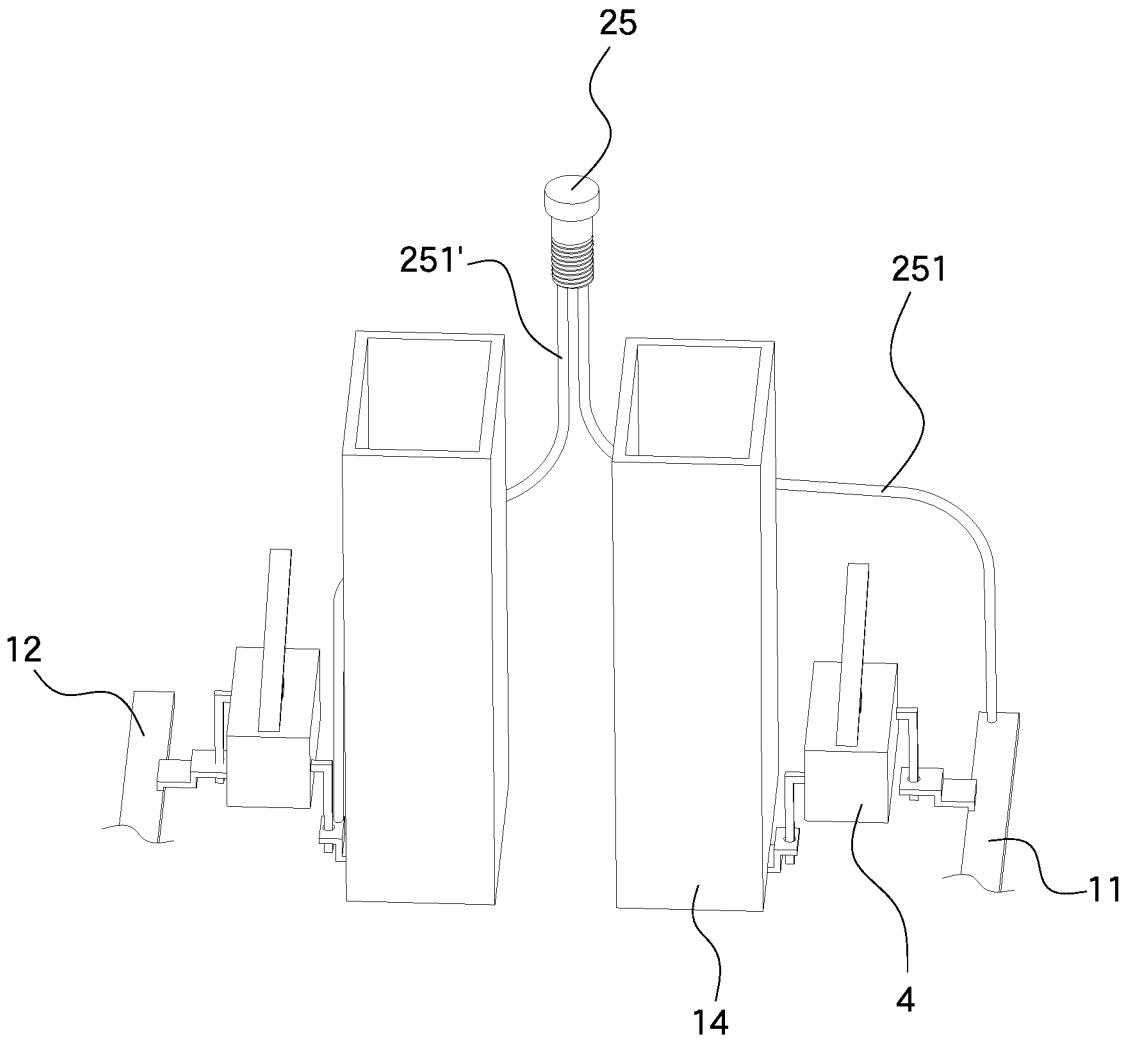
FIG. 14 shows the bottom compartments of the safety receptacle of the present invention as shown in FIG. 13.
Figure 15:
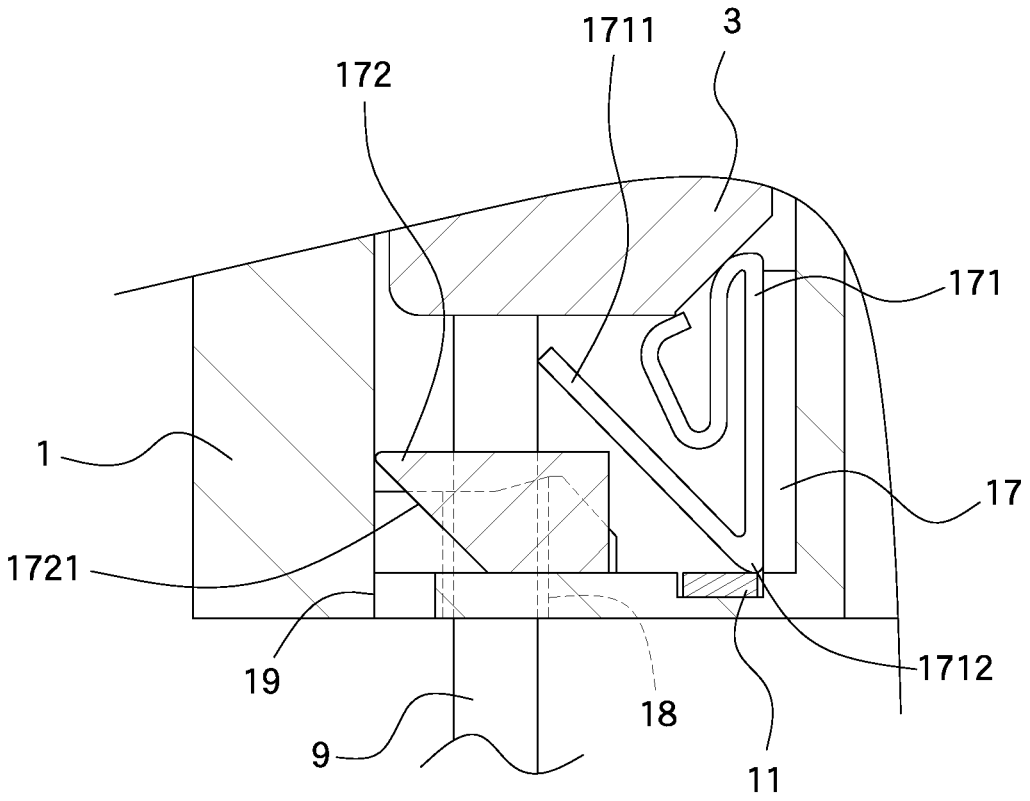
FIG. 15 is a cross sectional view, taken along line C-C of FIG. 9, and also shows a cable is inserted into the guide hole.
Figure 16:
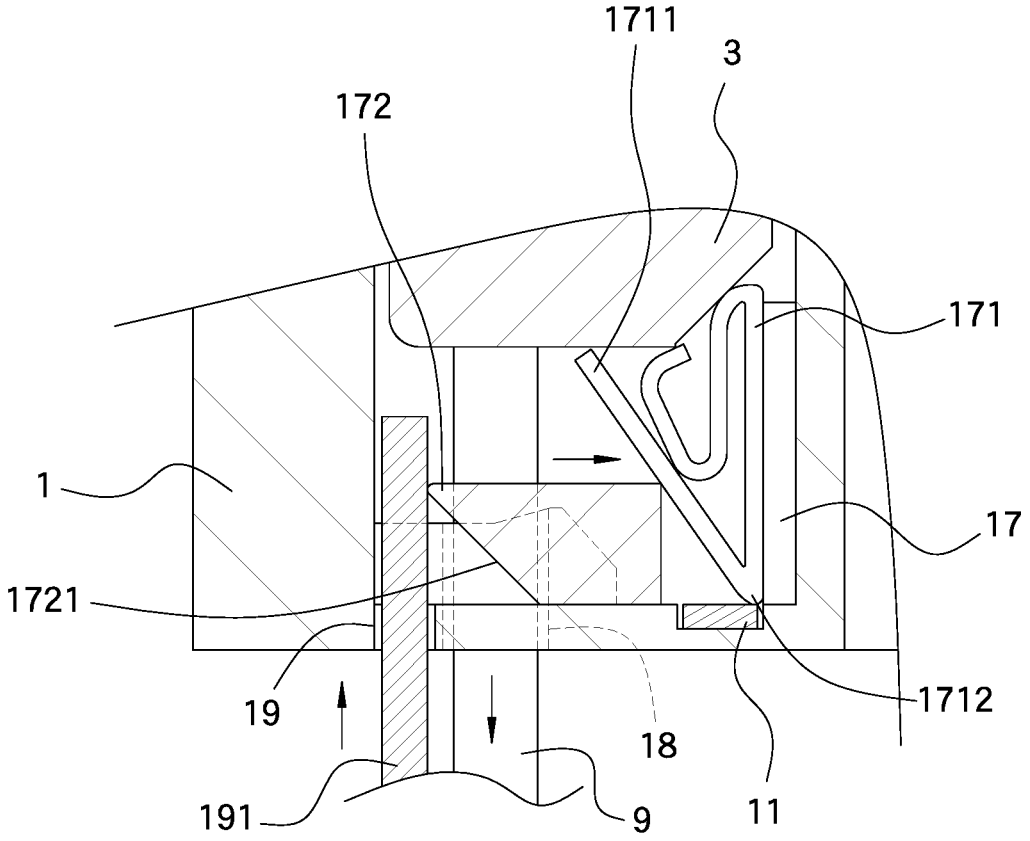
FIG. 16 shows that a tool is inserted into the cut-off of the safety receptacle of the present invention.

As shown in FIGS. 9 to 16, the second embodiment of the present invention is disclosed, the differences from the first embodiment are that the safety receptacle is installed to a wall and is connected with the electric wiring 9 from the city power source. The electric wiring 9 is used to provide electric power to the first and second conductive members 11, 12, so that the second embodiment does not need the cable 8. The base 1 includes two engaging grooves 17 which are located corresponding to the first and second conductive members 11, 12. The engaging grooves 17 each have a positioning member 171 engaged therewith. The positioning members 171 are electric conductive and are respectively connected to the first conductive member 11 and the second conductive member 12. Each positioning member 171 has an engaging portion 1711 and a bent portion 1712 which is a resilient portion. The engaging portion 1711 is located corresponding to a guide hole 18 in the base 1. Two slides 172 are respectively located between the first conductive member 11 and the engaging groove 17 corresponding to the first conductive member 11, and between the second conductive member 12 and the engaging groove 17 corresponding to the second conductive member 12. Each slide 172 has an inclined face 1721. The base 1 has two cut-offs 19 which are respectively located corresponding to the two respective inclined faces 1721. The engaging portion 1711 is biased by the bent portion 1712 to block the axial projection position of the guide hole 18 and contacts the slide 172. When the inclined face 1721 of the slide 172 is pushed along the axial direction of the guide hole 18, the inclined face 1721 contacts the engaging portion 1711 to un-block the axial projection position of the guide hole 18. The base 1 includes the indication members 181 on the underside thereof as shown in FIG. 12 to guide the users to insert the electric wiring 9 into the guide holes 18 as shown in FIG. 15. The bent portion 1712 resiliently pushes the engaging portion 1711 and the distal end of the engaging portion 1711 contacts and position the electric wiring 9. When the electric wiring 9 is to be removed, as shown in FIG. 16, a tool 191 is inserted into the cut-off 19 to push the inclined face 1721 of the slide 172 so that the slide 172 pushes the engaging portion 1711 to remove the electric wiring 9 via the guide hole 18.

The second embodiment does not have the warning light 23, and further includes a lighting unit 25 to each conductive unit 2 while still the function as the warning light 23 has. The cover 3 has a hole 37 which is located corresponding to the lighting unit 25. The lighting unit 25 is connected to two wire 251, 251', wherein the wire 251 is connected to the first conductive member 11, and the wire 251' is connected between the second seat 22 and the micro switch 4 corresponding to the second seat 22. Therefore, when a circuit is formed between the first and second seats 21, 22, the lighting unit 25 lights to acknowledge the users. The lighting unit 25 is cooperated with a seal ring 252 and is installed similar to that of the warning light 23.

The second embodiment of the present invention is used to be installed to a wall so that the cover 3 can be multiple-layer and a seal ring 38 is located between the layers to have water-proof feature.

While we have shown and described the embodiment in accordance with the present invention, it should be clear to those skilled in the art that further embodiments may be made without departing from the scope of the present invention.

What is claimed is:

1. A water-proof and explosion-free reception safety receptacle comprising:

a base having a first conductive member and a second conductive member, at least one conductive unit, first and second bottom compartments which are insulated, and an opening, a cover mounted to the opening of the base;

the at least one conductive unit having a first seat and a second seat respectively located in the first and second bottom compartments, a first micro switch being connected between the first conductive member and the first seat for interruptible electrical coupling of the first conductive member and the first seat, a second micro switch being connected between the second conductive member and the second seat for interruptible electrical coupling of the second conductive member and the second seat, the at least one conductive unit having a button switch, a resilient unit biased to an underside of the button switch, and the cover having a plurality of slots, first and second top compartments located at an underside of the cover, and at least one hole, the slots located corresponding to the first and second seats, the first and second top compartments respectively located corresponding to and positioned inside the first and second bottom compartments, the at least one hole located corresponding to the button switch which protrudes beyond the at least one hole by the resilient unit, the plurality of slots adapted to accept at least one plug to be inserted therein, the first and second seats each configured for electrically coupling with a terminal plate of the plug, the button switch being pushed to compress the resilient unit by the plug to activate the micro switches, so that the first conductive member is electrically connected to the first seat, and the second conductive member is electrically connected to the second seat, the first and second top compartments each having a seal ring mounted to an outside thereof, each seal ring of a top compartment being engaged between an underside of the cover and the bottom compartment corresponding to the top compartment, wherein the base further has at least one positioning member corresponding to the at least one button switch, the positioning member having a restriction groove defined therein, the resilient unit accommodated within the restriction groove, wherein the button switch includes two positioning portions extending from sides thereof, each positioning portion being connected with an upright portion, each upright portion having a recess defined in a distal end thereof so as to be engaged with a corresponding one of the first and second micro switches, and wherein the at least one button switch has a water-proof cap mounted to the top thereof, the water-proof cap having a connection portion formed on the periphery thereof, the cover having a connection portion formed to the hole and connected to the connection portion of the water-proof cap.

2. The water-proof and explosion-free reception safety receptacle as claimed in claim 1, wherein the at least one conductive unit includes a warning light, wherein the cover includes a bore in which the warning light is located, wherein the warning light includes a first lighting member connected to a first wire, and a second lighting member connected to a second wire, and wherein the first wire is connected to the first conductive member, the first wire is additionally connected between the second seat and the micro switch corresponding to the second seat, the second wire is connected to the second conductive member, and the second wire is additionally connected between the first seat and the micro switch corresponding to the first seat.

* * * * *